United States Patent [19]

Blomquist et al.

[11] Patent Number: 4,472,071

[45] Date of Patent: Sep. 18, 1984

[54] APPARATUS FOR ADJUSTING THE DISTANCE BETWEEN THE PRINT HEAD AND PLATEN

[76] Inventors: James E. Blomquist; Robert H. Wilczewski, both of 203 E. Main, Riverton, Wyo. 82501

[21] Appl. No.: 572,633

[22] Filed: Jan. 20, 1984

Related U.S. Application Data

[60] Division of Ser. No. 301,641, Sep. 14, 1981, , which is a continuation-in-part of Ser. No. 256,032, Apr. 21, 1981, abandoned, which is a division of Ser. No. 38,724, May 14, 1979, Pat. No. 4,279,518.

[51] Int. Cl.[3] ..... B41J 3/12; B41J 11/20; B41J 25/30

[52] U.S. Cl. ..... 400/59; 400/57; 400/124; 400/354

[58] Field of Search ..... 400/57–57, 400/59, 124, 320, 352, 354; 384/295; 101/93.05

[56] References Cited

U.S. PATENT DOCUMENTS

| | | | |
|---|---|---|---|
| 1,020,906 | 3/1912 | Hess | 384/295 |
| 3,960,256 | 6/1976 | Bickoff et al. | 400/59 X |
| 4,243,331 | 1/1981 | Savage et al. | 400/59 |
| 4,268,177 | 5/1981 | Veale | 400/59 X |

*Primary Examiner*—Paul T. Sewell
*Attorney, Agent, or Firm*—W. Scott Carson

[57] ABSTRACT

This invention involves methods and apparatus relating to the assembly and structure of a dot matrix print head. The invention includes a single unit, coil assembly of a bobbin, coil, and clapper which can be removeably placed as a unit among fixed pole pieces and yoke members in the print head. The print head also includes a supporting arragement for the coil assemblies which automatically aligns the clapper of each coil assembly with the impact end of one of the print wires during the assembly of the print head. Other disclosed features of the invention are novel designs for the wire guide members, a heat sink member, and mounting structure by which the print head is attached to the main guide and rail guide bearings of the printing mechanism. The invention also includes novel assembly aids and procedures which simplify and hasten the assembly of the print head including the use of assembly aids for inserting the print wires into the wire guide members and a grinding technique whereby all of the print wires can be easily and quickly ground to the proper length. With the novel print head design of this invention, the mounting plate, heat sink member, and coil assemblies can all be slideably assembled together and retained in place by snap-in, mating recess-detent arrangements between each bobbin and pole piece. In this manner, the print head can be easily and quickly assembled for operation and easily and quickly disassembled for repairs.

2 Claims, 29 Drawing Figures

APPARATUS FOR ADJUSTING THE DISTANCE BETWEEN THE PRINT HEAD AND PLATEN

This application is a division of U.S. patent application Ser. No. 301,641 filed Sept. 14, 1981, which is a continuation-in-part of U.S. patent application Ser. No. 256,032 filed Apr. 21, 1981, now abandoned which is a division of U.S. patent application Ser. No. 38,724 filed May 14, 1979, now U.S. Pat. No. 4,279,518.

FIELD OF THE INVENTION

This invention relates to the field of dot matrix printing and more particularly to the field of dot matrix print heads for printing alpha-numeric characters and symbols.

BACKGROUND OF THE INVENTION AND PRIOR ART

Much of the current activity in the dot matrix print head industry is being directed to improving the printing speed (characters per second, lines per minute) of the head to meet the needs of large company users. Such increased printing speed is usually accomplished with little thought being given to and at the expense of ease of manufacture, cost, reliability, ease of repair, degree of training needed to perform repairs, ruggedness, long life, and cost-performance ratios. Often, these current print head designs require the use of expensive and sophisticated materials and technology such as tungsten print wires, synthetic ruby bearings, and powdered metal technology with its expensive and scarce blends.

In direct contrast to the high speed printing needs of large company users are the needs of the rapidly developing personal computer market and small business computer market. In the personal and small business computer markets, the printing speed of the head is of relatively minor and secondary importance in comparison to cost, reliability, ruggedness, long life, ease of repair, and the degree of training necessary to perform repairs. It was with these needs of the personal and small business computer markets in mind that the present invention was developed. In contrast to the expensive and somewhat exotic manufacturing technique used in making most of the current print heads (e.g., powdered metal technology, tungsten print wires), the present invention uses simpler stamping and screw machine technique, cheaper materials such as steel print wires, and greatly simplified manufacture and assembly procedures including the use of assembly aids for inserting the print wires into spaced-apart guide members, a grinding aid and method whereby all of the print wires can be more easily and quickly ground to the proper length, and unique coil assembly and mounting plate designs whereby the clappers or armatures are automatically aligned with the impact ends of the print wires during the assembly of the print head.

Illustrative of the state of the art in dot or wire matrix print heads are the following U.S. Patents:

| | |
|---|---|
| 3,333,667 | Nordin |
| 3,467,232 | Paige |
| 3,828,908 | Schneider |
| 3,842,955 | Iwasaki |
| 3,854,564 | Flaceliere et al |
| 3,889,793 | Cattaneo |
| 3,896,918 | Schneider |

-continued

| | |
|---|---|
| 3,897,865 | Darwin et al |
| 3,929,214 | Hebert |
| 3,991,869 | Berrey |
| 3,994,381 | Hebert |
| 4,004,671 | Kondur, Jr. |
| 4,004,673 | Burzlaff et al |
| 4,009,772 | Glaser et al |
| 4,049,107 | Murat |
| 4,049,108 | Giessner |
| 4,051,941 | Hebert |
| 4,060,161 | Nelson et al |
| 4,079,824 | Ku |
| 4,081,067 | Schrag et al |
| 4,091,909 | Lee |
| 4,117,435 | Hishida et al |
| 4,135,830 | Hishida et al |
| 4,140,406 | Wolf et al |
| 4,141,661 | Geis et al |

None of these patents, however, discloses the unique features of the present invention nor do any of these prior patents meet the needs and requirements of the developing personal and small business computer markets as well as the present invention.

SUMMARY OF THE INVENTION

This invention involves new and novel methods and apparatus relating to the assembly and structure of a dot matrix print head. The invention includes a unique coil assembly design comprising a bobbin, coil, and clapper built as a single unit that can be removeably placed among fixed pole pieces and yoke members mounted about a wire guide assembly. In the coil assembly, the bobbin has a first portion with an open-ended, hollow shape dimensioned to slideably receive a pole piece. It also has second and third bobbin portions mounted to and extending outwardly in opposite directions from this first bobbin portion. The coil is mounted about the first bobbin portion and the clapper of the coil assembly is mounted between the second and third bobbin portion for movement relative to the bobbin. The clapper mounting means on the second and third bobbin portion positions the central axis of the clappers substantially perpendicular to the axis of symmetry of the first bobbin portion and also includes means for restraining the clapper from movement along the central axis relative to the bobbin. In a second embodiment, a unique return spring arrangement is provided between the second bobbin portion and one end of the clapper.

The invention also includes a novel arrangement for supporting the coil assemblies in the print head whereby the clapper of each coil assembly is automatically aligned with the impact end of one of the print wires during the assembly of the print head. This supporting arrangement includes a mounting plate with free standing yoke portions and a plurality of pole pieces affixed to the mounting plate. The mounting plate, integral yoke portions, and pole pieces are all affixedly positioned relative to the wire guide assembly holding the print wires. Each second bobbin portion of each coil assembly also has an alignment slot dimensioned to slideably receive a respective yoke portion so that each coil assembly can be slid into place by receiving a pole piece in the first bobbin portion and a yoke portion in the alignment slot of the second bobbin portion. In this manner, the clapper of the respective coil assembly is automatically aligned with the impact end of one of the print wires during the assembly of the print head. This arrangement greatly simplifies the assembly process of the print head and significantly reduces the time required to assemble the print head for operation.

Other novel structural features of the present invention include unique designs for a heat sink member, wire guide members, snap-in retaining means between the bobbin and pole pieces, and mounting structure by which the print head is attached to the main guide and rail guide bearings of the printing mechanism. The present invention also includes novel methods of assembling the components of the print head including the use of assembly aids for inserting the print wires into the wire guide members and a grinding technique whereby all of the print wires can be easily and quickly ground to the proper length.

DETAILED DESCRIPTION OF THE PREFERRED EMBODIMENTS

Figure 1:
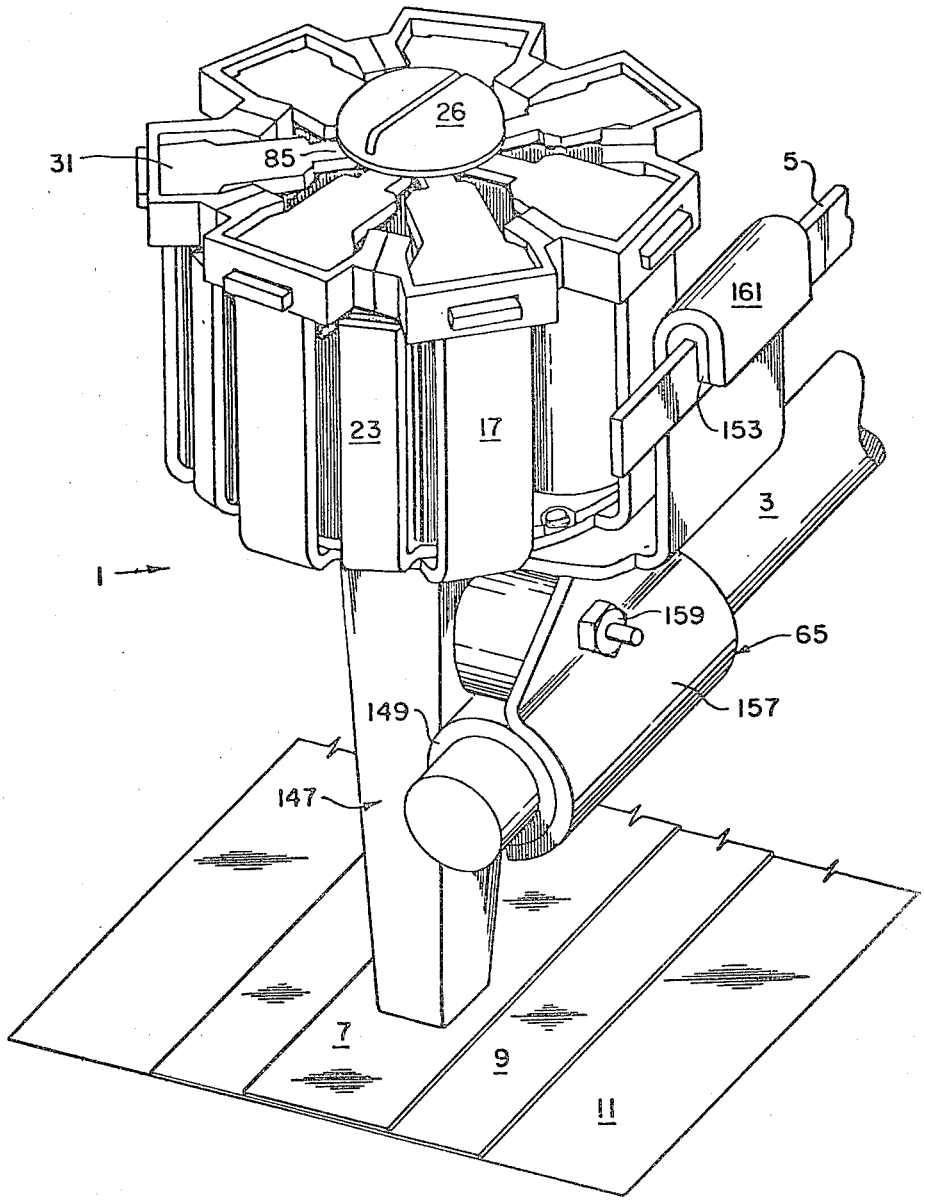
FIG. 1 is a perspective view of the print head of the present invention shown in use in one contemplated environment. For the sake of clarity, upstanding guide members 43 on the second portions of the bobbin members near the retaining screw 26 are not shown in this view.
Figure 2:
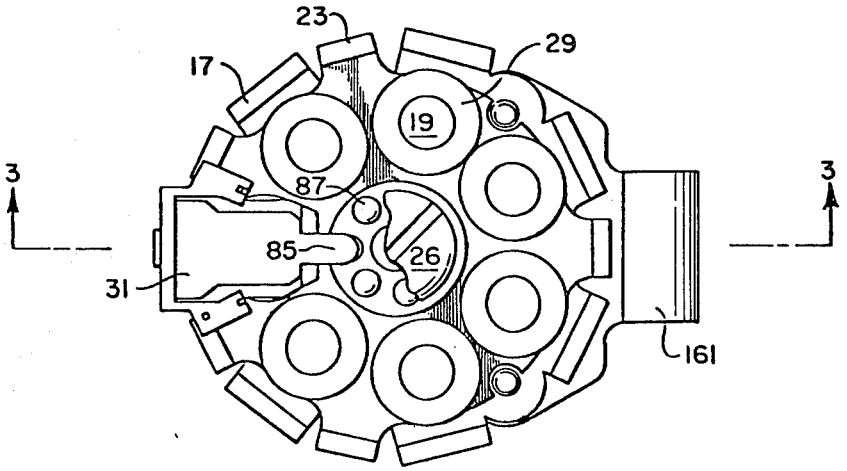
FIG. 2 is a top view of the print head of the present invention with some parts broken away and others not shown for the sake of clarity.

FIG. 1 is a perspective view of the print head 1 of the present invention shown in use in one contemplated environment. In this view, the print head 1 is mounted for movement along head shaft 3 and rear guide rail 5 relative to the ribbon 7, paper 9, and platen 11. As best seen in FIGS. 1–4, the print head 1 of the present invention includes wire guide assembly 13, mounting plate 15 with upstanding yoke portion 17, pole pieces 19 fixedly secured to the mounting plate 15, heat sink member 21 with upstanding fingers 23, coil assemblies 25, and retaining screw 26 with resilient backstop 28.

Figure 3:
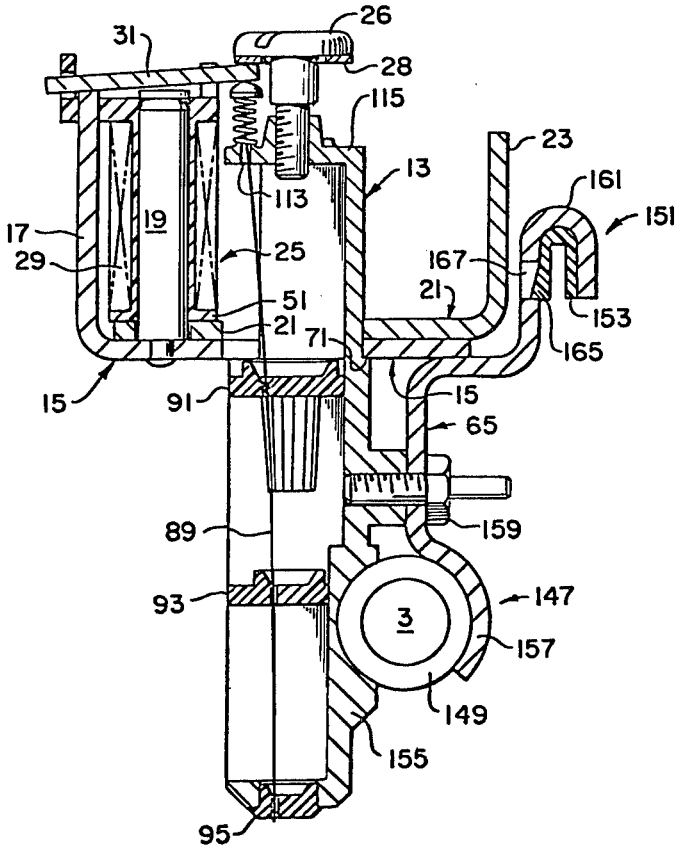
FIG. 3 is a cross-sectional view of the print head taken along line 3—3 of FIG. 2.
Figure 4:
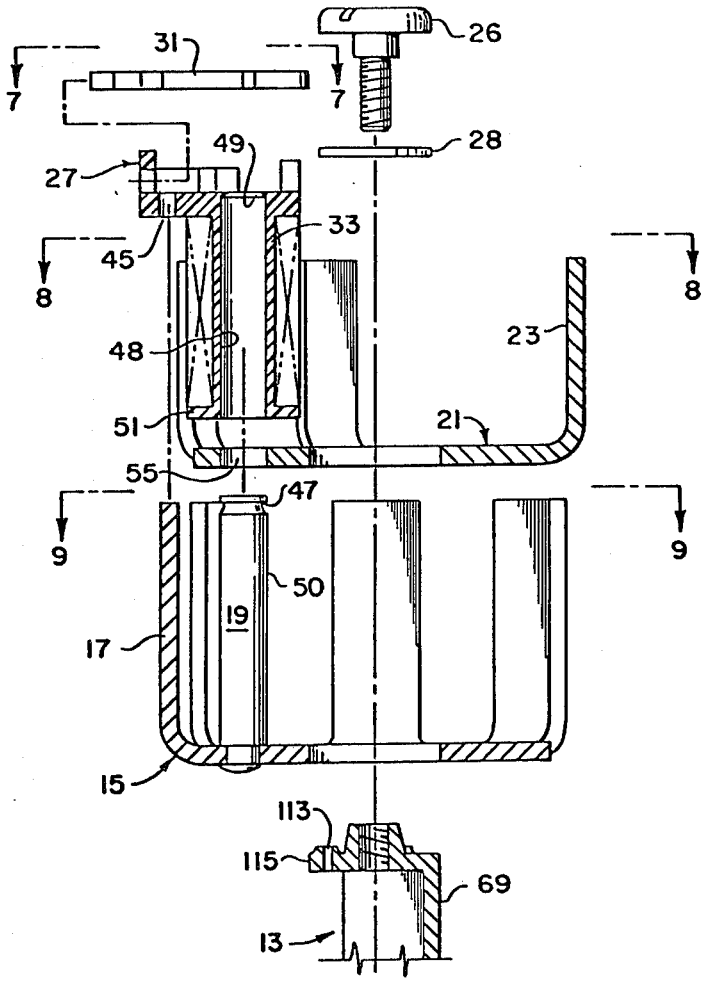
FIG. 4 is a partially exploded view of the top half of FIG. 3 showing the relationship between many of the major parts of the print head including the coil assembly, heat sink member, mounting plate with its integral yoke portions, pole pieces, and the wire guide assembly.
Figure 5:
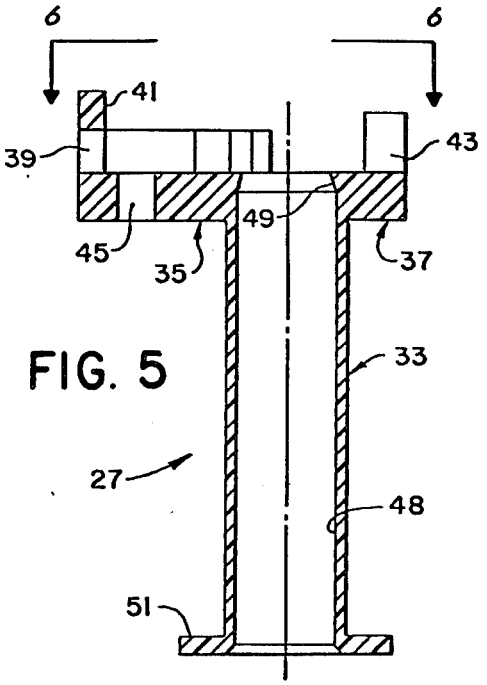
FIG. 5 is a cross-sectional view of the bobbin member of the coil assembly of the present invention.
Figure 6:
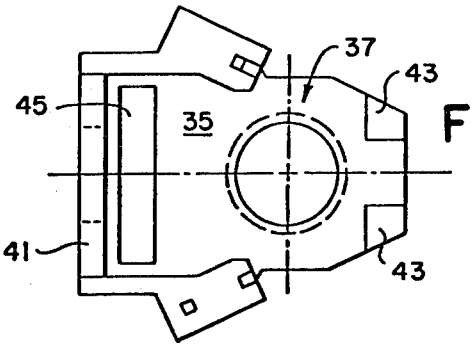
FIG. 6 is a top view of the bobbin member taken along line 6—6 of FIG. 5.
Figure 7:
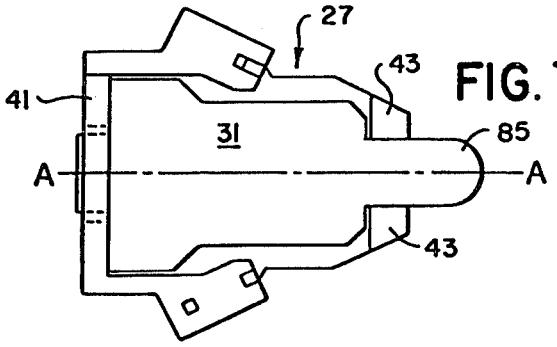
FIG. 7 is a top view of the coil assembly of the present invention taken along line 7—7 of FIG. 4 shown with the clapper member in its operating position on the bobbin member.

Coil assemblies 25 each include a bobbin member 27, coil member 29, and clapper member 31. As best seen in FIGS. 4–7, the bobbin member of the coil assembly has first, second, and third portions. The first portion 33 has an open-ended, hollow shape dimensioned to slideably receive one of the pole pieces 19 therein. The second and third bobbin portions 35 and 37 are attached to and extend outwardly of a common end of the first portion 33 in substantially opposite directions as best seen in FIGS. 5 and 6. The second and third bobbin portions 35 and 37 include means for mounting the clapper member 31 therebetween for movement relative to the bobbin member. The clapper member mounting means includes the rear slot 39 in the upstanding member 41 of the second bobbin portion 35 and the slot between upstanding guide members 43 on the third bobbin portion 37. For clarity, guide members 43 are not shown in the perspective view of FIG. 1. The clapper member 31 is dimensioned to extend outwardly of the central axis A—A at the rear and middle of the clapper member 31 to engage respectively the members 41 and 43 whereby these members serve to restrain the clapper member 31 from movement along the central axis A—A relative to the bobbin member 27 as seen in FIG. 7. Slot 45 in the second bobbin portion 35 serves as an alignment slot to slideably receive the upstanding portion 17 of the yoke member as shown in FIGS. 3 and 4. The members 41 and 43 of the second and third bobbin portion 35 and 37 also serve to restrict the movement of the clapper member 31 whereby the central axis A—A thereof remains in a predetermined plane relative to the bobbin member 27 with this predetermined plane intersecting the alignment slot 45. In operation, the central axis A—A of the clapper member 31 and the central axis of the first bobbin portion 33 remain substantially perpendicular. Also illustrated in FIGS. 3–5 is the recess-detent retaining means 47 and 49 between the inner surface 48 of the first bobbin portion 33 and the outer surface 50 of the pole piece 19 (see FIGS. 4 and 5). In assembling the bobbin member 27 on the pole piece, the pole piece 19 is first slideably received in the first bobbin portion 33 until the recess-detent retaining means 47 and 49 mate as will be explained in more detail herebelow. Also in the assembly procedure, the coil member 29 is mounted about the first bobbin portion 33 and retained in place by the second and third bobbin portions 35 and 37 on one end and the lip member 51 on the other end.

Figure 8:
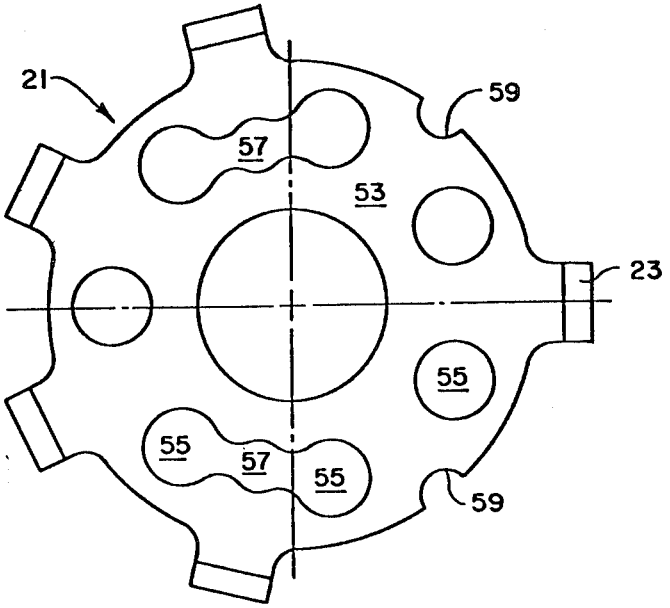
FIG. 8 is a view along line 8—8 of FIG. 4 showing a top view of the heat sink member of the present invention.
Figure 9:
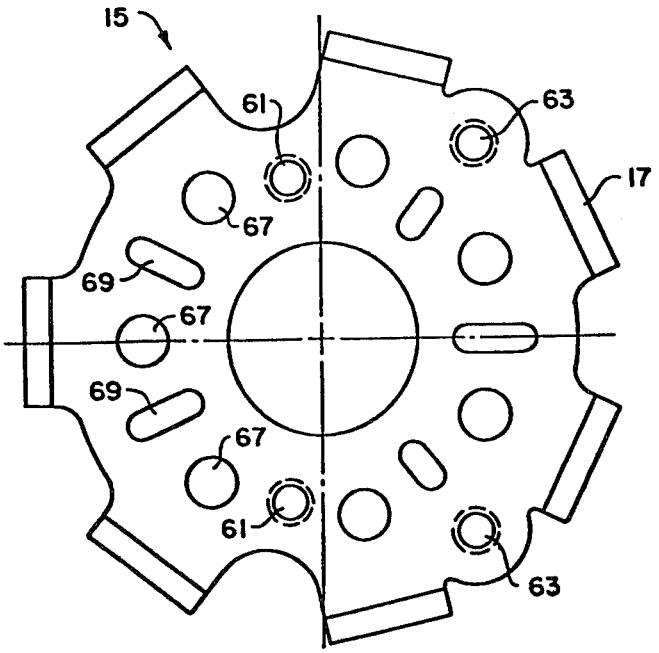
FIG. 9 is a view along line 9—9 of FIG. 4 showing a top view of the mounting plate of the present invention.

The heat sink member 21 and mounting plate 15 are best seen in FIGS. 1–4, 8, and 9. Heat sink member 21 in FIG. 8 has a planar portion 53 with alignment slots 55 therethrough dimensioned to slideably receive the pole pieces 19 as shown in FIGS. 3 and 4. Holes 57 and semi-circular holes 59 in FIG. 8 are slightly larger than and designed to align with holes 61 and 63 in the mounting plate 15 of FIG. 9 to receive the heads of screws holding the mounting plate 15 to the wire guide assembly 13 and holding the rear guide rail, bearing support 65 to the mounting plate 15. Fingers 23 are integral with and extend upwardly from planar portion 53 of the heat sink member 21. Mounting plate 15 has holes 67 in FIG. 9 for receiving the ends of pole pieces and retaining them with the axes of the pole pieces substantially parallel to the axis of the wire guide assembly 13 in FIG. 3. Holes 69 in the mounting plate 15 are present to reduce cross-talk between the coil assemblies 25.

In assembling the print head 1 as best seen in FIGS. 3 and 4, the mounting plate 15 is first slid over the top portion 69 of the plastic, wire guide assembly 13 until it abuts the ledge 71 as shown in FIG. 3. The mounting plate 15 is then fixedly secured to the wire guide assembly 13 by screws placed in holes 61 and extending between the mounting plate 15 and outwardly extending ears (not shown) of the wire guide assembly 13. Screws are then placed through holes 61 to secure the bearing support 65 to the mounting plate 15. The heat sink member 21 is then moved downwardly in FIG. 4 to receive the pole pieces 19 in the alignment slots 55 until the heat sink member 21 abuts the mounting plate 15. Coil assemblies 25 are then moved downwardly in FIG. 4 to slideably receive the pole pieces 19 in the first bobbin portions 33 and the yoke portions 17 in alignment slots 45 of the second bobbin portions 35 until the recessed-detent retaining means 47 and 49 on the inner and outer surfaces 48 and 50 of the pole pieces 19 and first bobbin portions 33 mate. The first bobbin portion 33 is dimensioned so that the mating recess and detent 47 and 49 firmly holds the planar portion 53 of the heat sink member 21 between the lip member 51 and mounting plate 15 as shown in FIG. 3. When assembled, heat sink member 21 helps to transfer heat generated in the area of the pole pieces 19 and coil members 29 outwardly to the finger members 23. Also when assembled, the finger members 23 of the heat sink member 21 and the upstanding yoke portion 17 of the mounting plate 15 are interspersed to provide more surface area for heat loss and to substantially prevent access as by fingers, paper clips, and the like to the interior of the print head 1.

Of particular note in this assembly process is the interaction between the upstanding yoke portions or alignment members 17 and the alignment slots 45 in the second bobbin portions 35. Specifically, the alignment slots 45 are dimensioned to slideably receive the upstanding ends of the yoke portions 17 in a close fitting relationship. By receiving respective pole pieces 19 in the first bobbin portions 33 and the yoke portions 17 in the alignment slots 45 of the second bobbin portions 35, each coil assembly 25 is automatically aligned during assembly with the impact end 85 of the clapper member 31 in FIGS. 2 and 3 against the impact end 87 of one of the print wires 89. Further, as illustrated in FIG. 3, the free standing ends of the yoke portions 17 abut the clapper member 31 when the recess and detent 47 and 49 mate and serve respectively as fulcrums for the clapper members 31.

Figure 11:
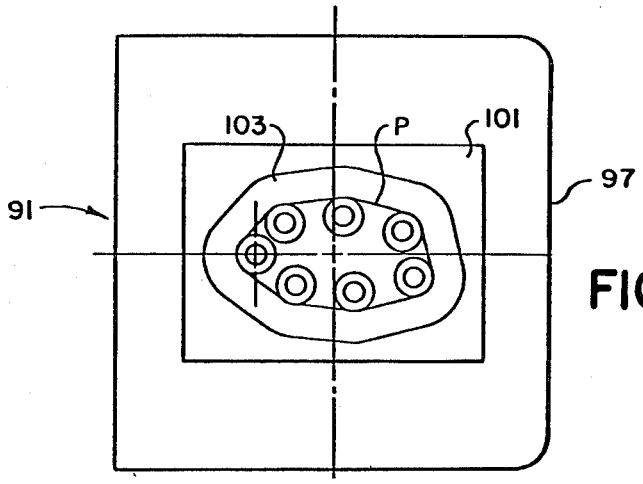
FIG. 11 is a top view of the rear wire guide member taken along line 11—11 of FIG. 10.
Figure 10:
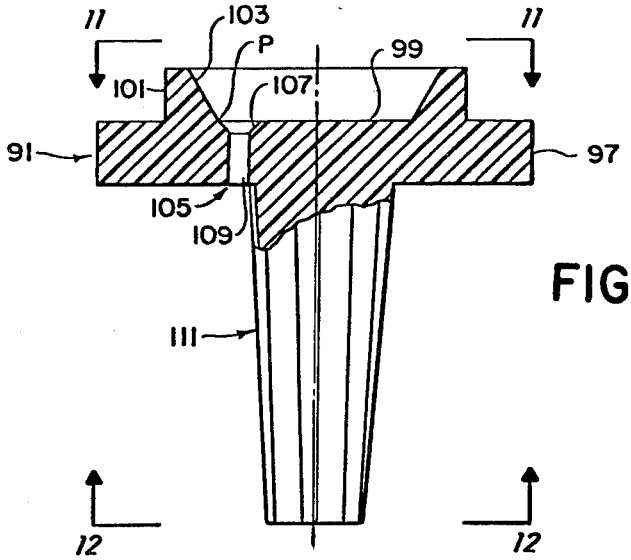
FIG. 10 is a partial cross-sectional view of the rear wire guide member of the present invention.
Figure 12:
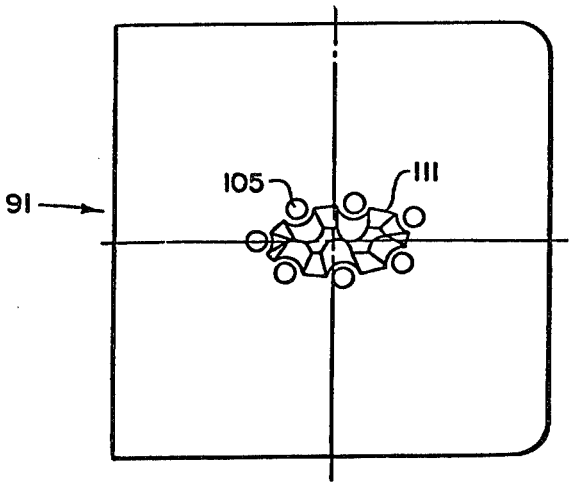
FIG. 12 is a bottom view of the rear wire guide taken along line 12—12 of FIG. 10.
Figure 14:
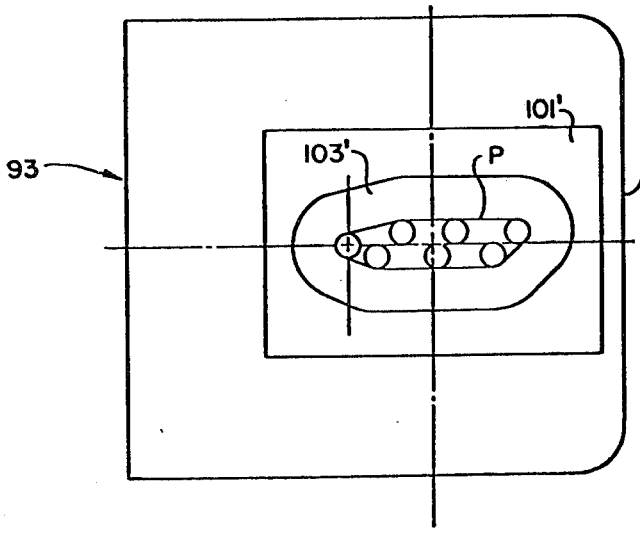
FIG. 14 is a top view of the middle wire guide member taken along line 14—14 of FIG. 13.
Figure 13:
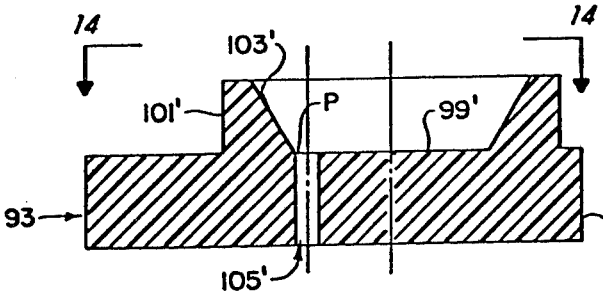
FIG. 13 is a cross-sectional view of the middle wire guide member of the present invention.
Figure 16:
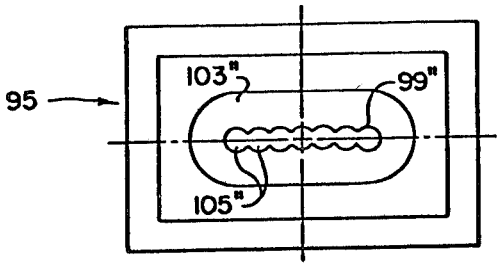
FIG. 16 is a top view of the front wire guide member taken along line 16—16 of FIG. 15.
Figure 15:
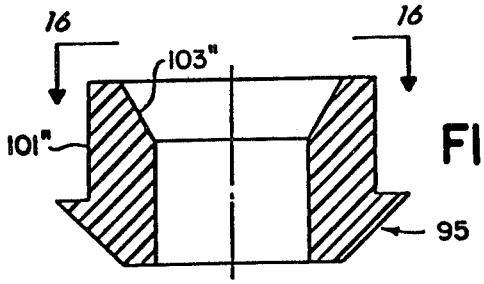
FIG. 15 is a cross-sectional view of the front wire guide member of the present invention.

FIGS. 10–17 illustrate the rear, middle, and front wire guide members 91, 93, and 95 for the print wires 89. Rear and middle wire guide members 91 and 93 in FIGS. 10 and 13 each have a main body 97 and 97' with a planar surface 99 and 99' and a rim portion 101 and 101' attached to and extending upwardly from the planar surface 97 and 97'. The rim portion 101 and 101' has a cam surface 103 and 103' extending upwardly from the planar surface 99 and 99' and outwardly of an axis perpendicular to the planar surface 99 and 99'. The cam surface 103 and 103' intersects the planar surface 99 and 99' at a plurality of points forming a closed path in P as best seen in FIGS. 11 and 14. The rear and middle wire guide members 91 and 93 also have a plurality of holes 105 and 105' through the main body portion 97 and 97'. Each of these holes 105 and 105' extends along an axis substantially parallel to the above-mentioned axis of the cam surface 103 and 103' and intersects the closed path P. In this manner, the print wires 89 can be advanced toward the respective wire guide members 91 and 93 to first contact the cam surface 103 and 103' of the rim portion 101 and 101' and then slideably moved therealong into one of the holes 105 and 105'. In the rear wire guide member 91 as shown in FIG. 10, the hole 105 is defined by first and second surfaces 107 and 109. The first surface 107 extends downwardly from the planar surface 103 and inwardly of the axis of the hole 105 to form a truncated cone shape. The second surface 109 is substantially cylindrical and extends downwardly from the first surface 107 about the axis of the hole 105. The front wire guide member 95 in FIGS. 15 and 16 also has a rim portion 101'' with a cam surface 103'' and a planar surface 99'' which is much smaller than corresponding planar surfaces 99 and 99' because the holes 105'' are aligned and interconnected as can be seen in FIG. 16.

Figure 17:
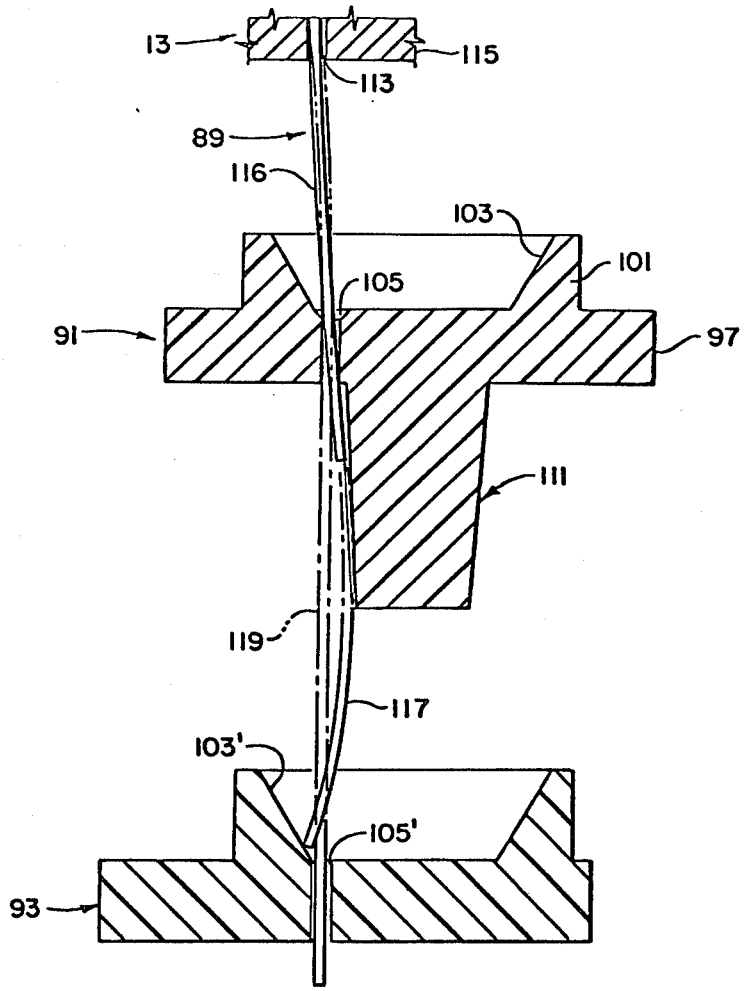
FIG. 17 is a cross-sectional view of the top rear, and middle wire guide members 115, 91, and 93 of the wire guide assembly illustrating the manner in which the grooved assembly aid attached to the rear wire guide member assists in the proper assembly of the print wires between the rear and middle wire guide members 91 and 93.

The grooved member 111 depending from the rear wire guide member 91 in FIG. 10 is an assembly aid for assisting the sequential insertion of the print wires 89 into the holes 105' of the middle wire guide member 93 as illustrated in FIG. 17. Referring to FIG. 17, the print wire 89 is first inserted through one of the holes 113 in the top wire guide member 115 shown in FIGS. 3, 4, and 17–19. The print wire 89 is then advanced along a substantially straight path (shown in solid lines in FIG. 17) toward and through the hole 105 in the rear wire guide 91 until the leading end of the print wire 89 contacts the grooved assembly aid 111 in the bottom of a predetermined groove thereof. By continuing to advance the print wire 89, the assembly aid 111 serves to apply a force to the print wire 89 in a direction substantially perpendicular to the substantially straight path 116 mentioned above whereby the print wire 89 assumes a first bowed shape defining a path 117. Further advancing of the lead end of the print wire 89 along the first bowed shaped path 117 causes the lead end to contact the cam surface 103′ of the middle wire guide member 93 where it is guided into the hole 105′. The cam surface 103′ serves as a second assembly aid and when the print wire 89 is passed through the hole 105′ in the middle wire guide member 93, the print wire 89 assumes a second bowed shape 119 which has less bow than the first bowed shape 117. In this manner, contact with the assembly aid 111 is eliminated and the print wire 89 only bears against the top, rear, and middle wire guide members 115, 91, and 93. This assembly technique using the assembly aids 111 and 103′ reduces the assembly time necessary to insert the print wires 89 and eliminates the need for an assembler to physically grip and guide the print wires 89 through the holes 105′ in the middle wire guide member 93.

Figure 18:
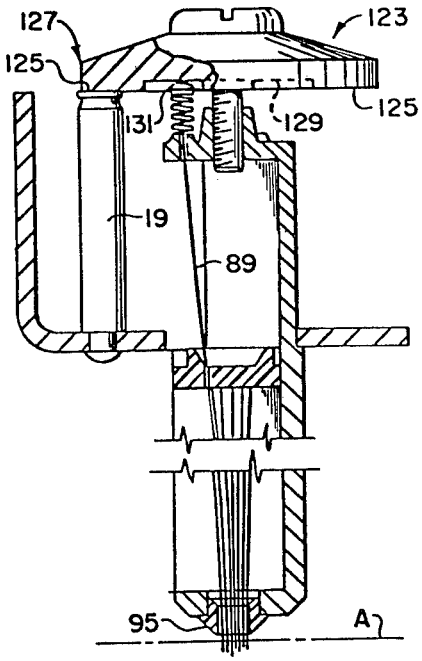
FIG. 18 is a partial, cross-sectional view of an assembly aid 111 and procedure whereby all of the print wires can be easily and quickly ground to the proper length.

FIG. 18 also illustrates an assembly technique for grinding all of the print ends of the print wires 89 so they lie in a common plane A in the impact area. In this assembly method, the cap 123 is screwed downwardly until the surface 125 of the rim portion 127 abuts the tops of the pole pieces 19. At this point, the inner, planar surface 129 of the cap 123 contacts all of the impact ends 131 of the print wires 89 and advances the print ends of the print wires 89 out of the front wire guide member 95 as illustrated in FIG. 18. The print ends are then ground off in a common plane which is perpendicular to the axis of the wire guide assembly 13 and parallel to the planar surface 129 of the cap 123. The distance between the rim surface 125 and the inner surface 129 of the cap 123 is exactly the thickness of the impact end 85 of the clapper member 31. Consequently, the cap 123 can be removed and replaced with restraining screw 26 and backstop 28 in FIGS. 3 and 19 whereby the restraining screw 26 is advanced until the surface 133 of the backstop 29 is exactly in the same place that inner surface 129 was in at the time of the grinding. In practice, this is accomplished by advancing the restraining screw 26 until it abuts surface 135 of the wire guide assembly 3 in FIG. 19 and then backing the restraining screw 26 off a predetermined number of turns.

Figure 19:
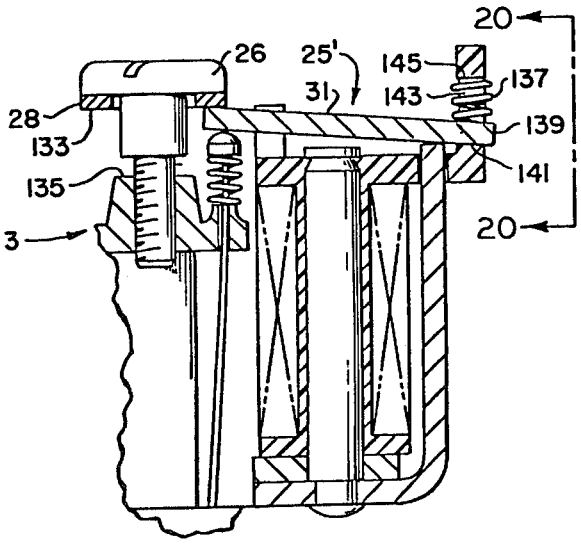
FIG. 19 is a cross-sectional view of a modified coil assembly design in which a return spring arrangement is mounted between the second bobbin member portion and the rear end of the clapper member.
Figure 20:
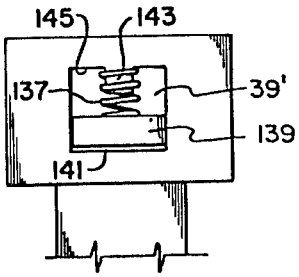
FIG. 20 is a view along line 20—20 of FIG. 19 showing a side view of the return spring arrangement for the clapper member.

FIGS. 19 and 20 illustrate views of a modified coil assembly 25′ of the present invention. In the modified coil assembly 25′, a return spring 137 is provided for biasing the rear end portion 139 of the clapper member 31 toward the bottom side 141 of the slot 39′. As seen in FIGS. 19 and 20, a post member 143 is attached to and extends downwardly from the top side 145 of the slot 39′. The free end of the post member 143 extends toward the bottom side 141 of the slot 39′ for about half the distance between the top and bottom sides 145 and 141. The coil spring 137 is positioned about the post member 143 between the top side 145 and the rear portion 139 of the clapper member 31 as illustrated in FIGS. 19 and 20. The cord spring 137 serves to bias the rear end portion 139 of the clapper member 31 toward the bottom side 141 of the slot 39 and away from the top side 145 and post member 143.

Further designs of the present invention for simplifying and reducing the time needed for assembly and disassembly include the clamp means 147 for removably mounting the print head 1 to the main guide bearing 149 in FIGS. 1 and 3 and the snap arrangement 151 for mounting the print head 1 to the bearing 153 which rides on the rear guide rail 5. In assembly, the print head 1 is clamped to the main guide bearing 149 by placing the main guide bearing 149 between clamp portion 155 on the print head 1 and clamp portion 157 on the lower end of the support member 65. Screw 159 and the screws holding the support member 65 to the mounting plate 15 as discussed above are then tightened so that the print head 1 is firmly clamped to the main guide bearing 149. The head shaft 3 could already be positioned in the main guide bearing 149 prior to this clamping or it can be slid into the main guide bearing 149 after the clamping procedure. The snap arrangement 151 by which the print head 1 is mounted to the bearing 153 includes the substantially U-shaped portion or member 161 on the top end of the support member 65 which has an inner surface substantially corresponding to the shape of the outer surface of the guide bearing 153. The guide bearing 153 has a resilient detent member 165 forming part of the outer surface. The inner surface of the U-shaped portion 161 has a mating recess portion 167 whereby the bearing 153 can be snapped into place and held against the U-shaped portion 161 of the support member 65 with the inner and outer surfaces thereof abutting each other. In one assembly procedure, the bearing 153 is snapped into place against the U-shaped portion 161 of the support member 65 and then the rear guide rail 5 inserted in the bearing 153 and in another procedure, the bearing 153 can be mounted on the rear guide rail 5 and then the U-shaped portion 161 snapped thereon.

Figure 21:
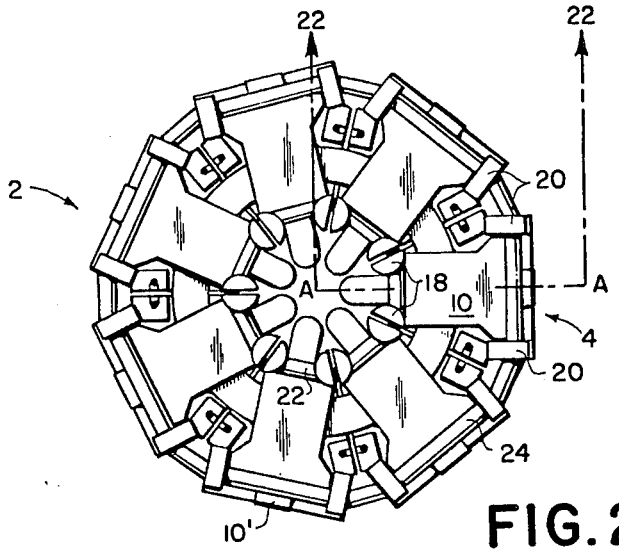
FIG. 21 is a top view of a print head with modified coil assemblies.
Figure 22:
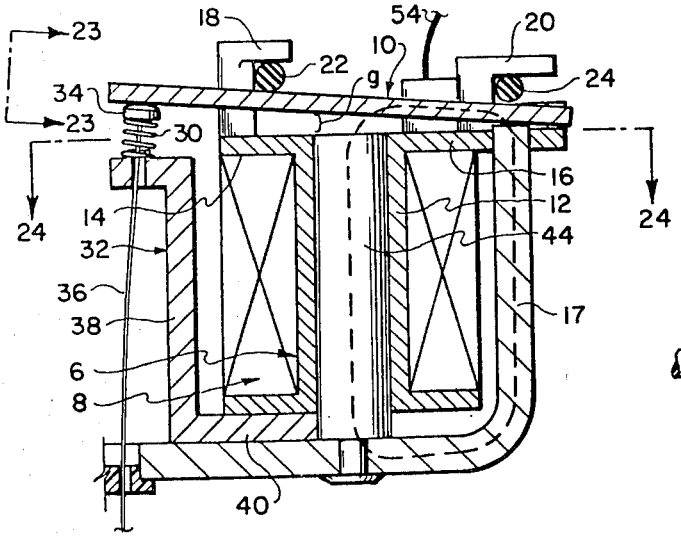
FIG. 22 is a cross-sectional view of the modified coil assembly taken along line 22—22 of FIG. 21.
Figure 23:
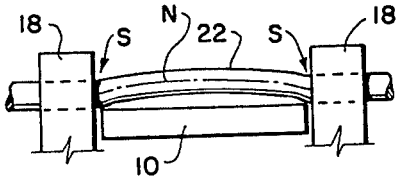
FIG. 23 is a view taken along line 23—23 FIG. 22.

In the print head 2 of FIGS. 21–28, a modified coil assembly 4 is illustrated. As best seen in FIG. 22 and like the other coil assemblies, the modified coil assembly 4 includes a bobbin member 6, coil member 8, and clapper member 10 with the coil member 8 being positioned about the first portion 12 of the bobbin member 6 and the clapper member 10 mounted between the second and third portions 14 and 16 of bobbin member 6. Unlike the other coil assemblies, the mounting means for the clapper member 10 of the modified coil assembly 4 includes inner and outer pairs of generally L-shaped members 18 and 20. As best seen in FIGS. 21–23, the inner and outer pairs of L-shaped members 18 and 20 of each bobbin member 6 are dimensioned to receive the clapper member 10 among them with the end portions of the clapper member 10 substantially abutting members 18 and 20. The clapper member 10 can be lifted out of or placed in the print head 2 by moving it relative to the L-shaped members 18 and 20 with the central axis A—A of the clapper member 10 remaining in a predetermined plane perpendicular to the view of FIG. 21. To keep the clapper member 10 in place, inner and outer elastic O-rings 22 and 24 are positioned in the included angles of the legs of the respective inner and outer pairs of L-shaped members 18 and 20 (see FIGS. 21 and 22). In this manner, any and all of the clappwer members 10 can be easily and quickly installed in or removed from the print head 2 by selectively removing and replacing O-rings 22 and 24 within the included angles of the L-shaped members 18 and 20. In an alternate procedure, the clapper members 10 can be placed in or removed from the print head 2 by removing just the outer O-ring 24, picking the tail 10' of the clapper member 10 up out of the mating detent 16' in the second bobbin member portion 16 (see FIGS. 21, 24, and 25), and then sliding the head 10'' of the clapper member 10 out from under the O-ring 22.

In the preferred embodiment, the return spring 30 of the wire guide assembly 32 (see FIGS. 22 and 25) biases the impact end 34 of the print wire 36 against the clapper member 10 and pivots the clapper member 10 about O-ring 22 into its home position (FIG. 22) when the coil member 8 is deactivated. In this home position, the clapper member 10 abuts the O-ring 22 and the upstanding yoke portion 17 but is spaced from the O-ring 24. As shown in FIG. 22, the O-ring 22 is preferably positioned well away from the impact end 34 of the print wire 36 a distance of about two and preferably three or four diameters of the O-ring 22 so that a significant moment arm is developed by the return spring 30 on the clapper member 10 between the impact end 34 and the pivot point at the O-ring 22. In this manner, the back of the clapper member 10 is held firmly against the yoke portion 17. As shown in FIG. 23, the O-ring 22 is tensioned along its neutral axis N and is in shear at S at the L-shaped members 18 when the clapper member 10 is in its home position.

Figure 25:
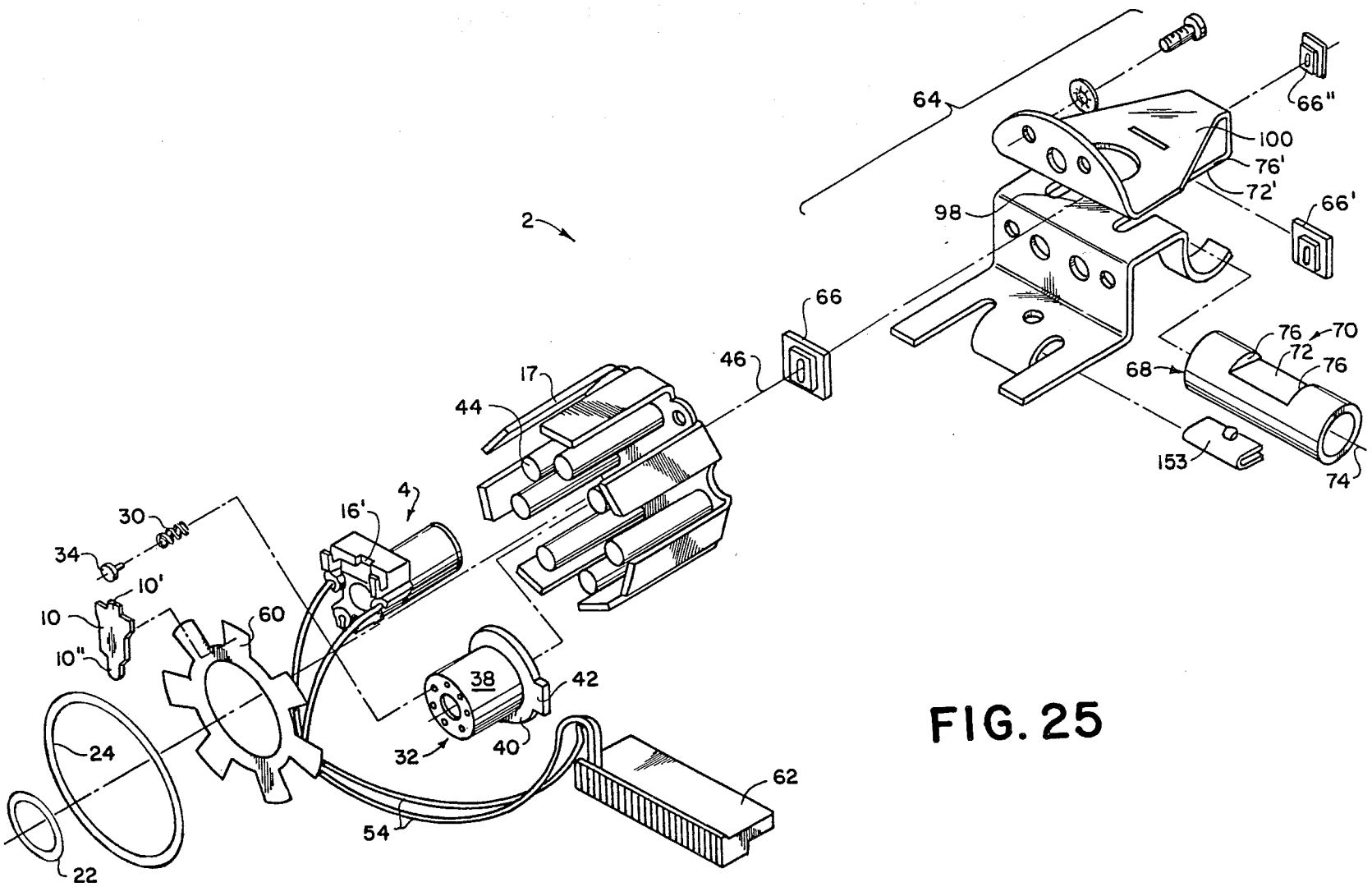
FIG. 25 is an exploded view of the print head of FIG. 21.

In assemblying the bobbin member 6 on the pole piece 44 in FIG. 22, the pole piece 44 is first received in the first portion 12 of the bobbin member 6 and then the bobbin member 6 is moved until the free end of the pole piece 44 is flush with the immediately adjacent planar surfaces of the second and third bobbin member portions 14 and 16 (see FIG. 22). Once in place, the bobbin member 6 is preferably held in place by a press fit or glue. The air gap g between the pole piece 44 and clapper member 10 is determined by the home position of the clapper member 10 (see FIG. 22). In its home position, the clapper member 10 abuts O-ring 22 and the upstanding yoke portion 17 under the biasing force of return spring 30. The portion 17 is fixed relative to pole piece 44 and the position of O-ring 22 in the included angle of L-shaped members 18 is fixed relative to the bobbin member 6. Consequently, the size of the of the gap g can be automatically and predictably adjusted by moving the bobbin member 6 relative to the pole piece 44. Adjustments in the gap g can obviously also be made by using different diameter O-rings 22 without having to move the bobbin member 6 relative to the pole piece 44. However, in the preferred embodiment, the desired gap g is calculated and the bobbin member 6 and O-ring 22 are then dimensioned so the correct gap g is automatically achieved when the free end of the pole piece 44 is flush with the second and third bobbin member portions 14 and 16 as illustrated in FIG. 22. When the coil member 8 is activated, the clapper member 10 moves from its home position to one abutting the pole piece 44 and second and third bobbin member portions 14 and 16 (actually there is a thin insulator 60 therebetween which is shown in FIG. 25 but not FIG. 22 for clarity). As the clapper member 10 moves between these two positions, the L-shaped members 18 and 20 maintain the central axis A—A of the clapper member 10 in a predetermined plane relative to the bobbin member 6.

Referring to FIGS. 22 and 25, the modified coil assembly 4 has a wire guide assembly 32 with a first portion 38 serving as a wire guide for print wires 36 (see FIG. 22) and an annular portion 40 which extends outwardly of the first portion 38. The annular portion 40 has a tab member 42 (see FIG. 25) extending outwardly of it. The pole pieces 44 are fixedly and symmetrically positioned about a first axis 46 fixed in relation to the print head. In the assembly procedure, the annular portion 40 abuts the pole pieces 44 to center the wire guide assembly 32 relative to the axis 46 and the tab member 42 extends radially between and abuts two pole pieces 44 to prevent rotation of the wire guide assembly 32 about the axis 46. The bobbin members 6 are retained on the pole pieces 44 by a press fit or glue and in the embodiment of FIGS. 21–27, the bobbin member 6 abuts the annular portion 40 of the wire guide assembly 32 (see FIG. 22) to prevent longitudinal movement of the wire guide assembly 32 along the axis 46. In the preferred assembly, the coil assemblies 4 are symmetrically positioned about the axis 46 with the L-shaped members 18 and 20 each having one leg extending parallel to the axis 46 and the other leg extending radially outwardly of the axis 46 (see FIGS. 21 and 22) so that the retaining O-rings 22 and 24 extend across the clapper members 10 generally transversely of the central axes A—A of the clapper members 10.

Figure 24:
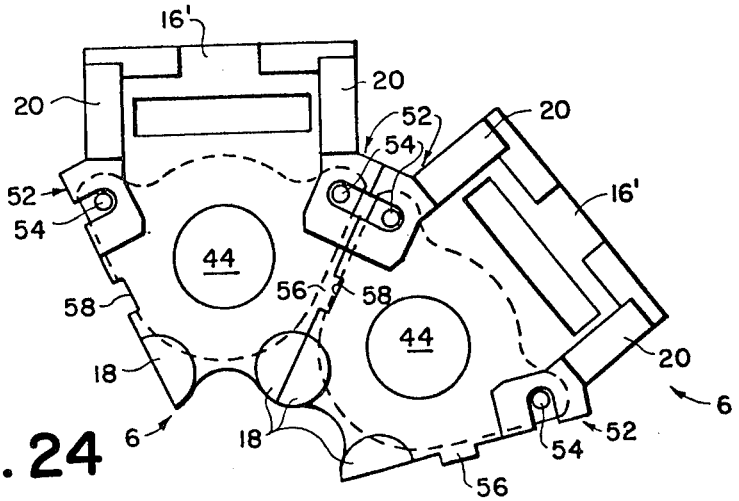
FIG. 24 is a view taken along line 24—24 FIG. 22 illustrating the abutting, interlocking relationship of the modified coil assemblies.

FIG. 24 illustrates the manner in which adjacent bobbin members 6 abut one another along the respective sides in an interlocking fashion. FIG. 24 also illustrates the manner in which the C-shaped retaining members 52 for the lead wires 54 of the coil members 8 also abut to form respective closed O-shapes about pairs of the lead wires 54. Referring to FIG. 24, the abutting sides of each bobbin member 6 have a respective male member 56 and corresponding female member or recess 58 with adjacent male and female interlocking in a mating relationship when the bobbin members 6 are mounted on the pole pieces 44. The interlocking also aids assembly and further serves to hold the bobbin members 6 in the correct positions in the print head 2 in addition to adding strength and dynamic integrity to the print head 2. Further, the assembly procedure of interlocking will also serve to correct small alignment errors. For example, if a pole piece 44 is slightly misaligned, the placing of the bobbin member 6 over it and then interlocking the bobbin member 6 with adjacent ones will physically move the pole piece to correct the misalignment and then keep it correctly aligned. The C-shaped retaining members 52 for the lead wires 54 of the coil members 8 also are an assembly aid and when positioned with adjacent ones abutting as in FIG. 24, they serve to effectively maintain pairs of the lead wires 54 from adjacent coil members 8 in the elongated, O-shape formed thereby.

Referring to FIG. 25, other parts of the print head 2 include the insulator 60, connector 62, snap-in near bearing 153, and nose assembly 64. The nose assembly 64 has multiple functions including acting as a retainer for wire guides 66, 66', and 66'' and as a heat sink for the print head 2 as explained in more detail below.

Referring again to FIG. 25, a modified main guide bearing 68 is shown wherein it has a recess 70 with planar surface 72 parallel to the axis 74 of the main guide bearing 68 and spaced-apart sides 76 perpendicular to axis 74. The nose assembly 64 (see also FIGS. 26–27) has a mating planar surface 72' and spaced-apart side surfaces 76' corresponding to 72 and 76 wherein the mating side surfaces 76 and 76' serve to prevent movement of the main guide bearing 68 along the axis 74 relative to the print head 2 and the mating planar surfaces 72 and 72′ prevent movement of the main guide bearing 68 about the axis 74 relative to the print head 2.

Figure 26:
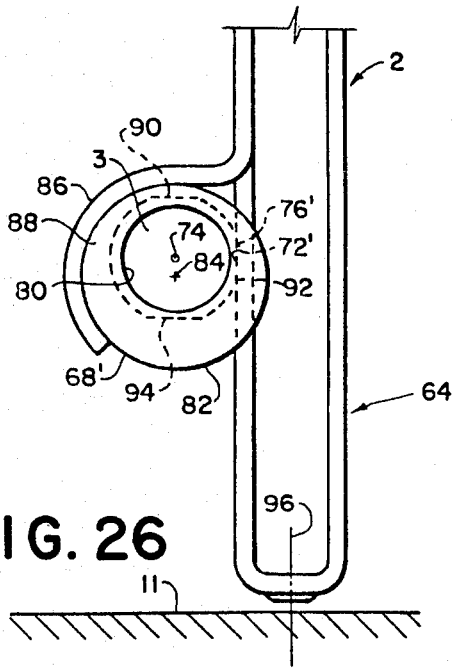
FIG. 26 is a cross-sectional view of a modified arrangement for resiliently attaching the print head to the main guide bearing which is mounted on the head shaft.
Figure 27:
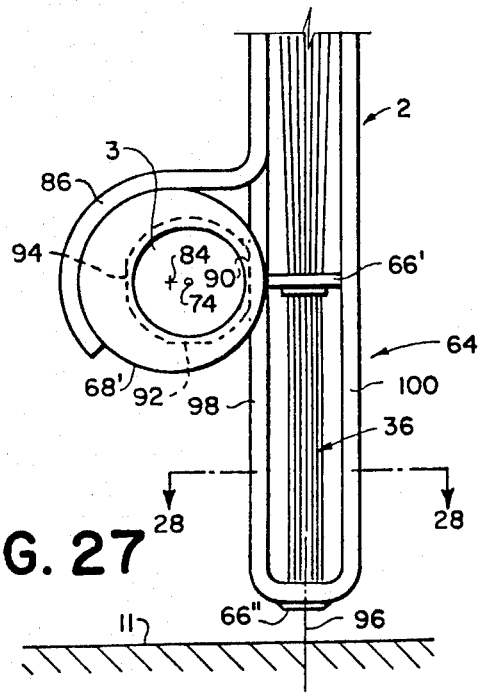
FIG. 27 is a cross-sectional view similar to FIG. 26 showing the manner in which the eccentric, main guide bearing can be rotated relative to the print head and head shaft to selectively move the print head toward and away from the platen to accommodate different paper thicknesses or multiple sheets of paper.

FIGS. 26–27 illustrates a modified arrangement for securing the print head 2 to the head shaft 3. In this modified arrangement, the main guide bearing 68′ has an inner cylindrical surface 80 symmetrically positioned about the axis of the head shaft 3 which is the same as axis 74. The outer cylindrical surface 82 of the main guide bearing 68′ is symmetrical about axis 84 which is parallel to and spaced from axis 74 wherein the surface 82 is eccentric relative to axis 74. The main guide bearing 68′ is resiliently mounted to the print head 2 by the resilient C-shaped clamp 86. As shown in FIGS. 26–27, the outer cylindrical surface 82 has a recess 88 thereabout centered on the axis 74. The recess 88 has three flat bottoms or detents at 90, 92, and 94 made up of planar surfaces parallel to axis 74. As in the case of main guide bearing 68 of FIG. 25, the nose assembly 64 of the print head 2 is matingly received on the recess 88 with the corresponding side surfaces 76 and 76′ abutting to prevent movement of the main guide bearing 68′ along the axis 74 relative to the print head 2. Unlike the embodiment of FIG. 25, the modified arrangement of FIGS. 26–27 permits the print head 2 to be selectively moved along its longitudinal axis 96 toward and away from the platen 11 so that the print head can accommodate different thicknesses of paper or multiple sheets of paper. To so adjust the print head 2, the main guide bearing 68′ can be rotated against the force of the resilient C-shaped clamp 86 between, for example, the positions of FIGS. 26 and 27. In FIG. 26, the planar surface or detent 92 abuts the print head 2 and in FIG. 27, planar surface 90 abuts the print head 2. The retaining force of the C-shaped clamp 86 is different in FIGS. 26 and 27; however, the distance between axes 74 and 96 is the same since planar detent 90, 92, and 94 are equidistant from axis 74. Further, axes 74 and 96 remain perpendicular to one another in FIGS. 26 and 27. The actual moving of the print head 2 relative to the platen 11 is accomplished as a result of the camming action between the eccentric outer surface 82 of the main guide bearing 68′ and the C-shaped clamp 86 which is fixedly attached to the print head 2.

Figure 28:
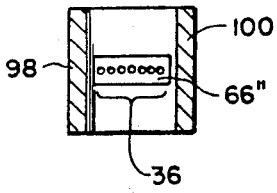
FIG. 28 is a view along line 28—28 of FIG. 27.

Referring to FIGS. 25–28, the nose assembly 64 is open sided in that the print wires 36 are retained between the two metallic planar members 98 and 100 of the nose assembly 64. In this manner, the print wires 36 can be easily reached with tweezers or other instruments from either of the open sides in case one or more of the print wires 36 need to be adjusted or replaced. As best seen in FIGS. 27 and 28 (the print wires 36 are not shown in FIG. 26 for the sake of clarity), the print wires 36 are aligned between retainers 66′ and 66″ substantially in a plane (see FIG. 28) which is perpendicular to the planar members 98 and 100 to further enhance the accessability of the print wires 36 from either of the open sides of the nose assembly 64. The open sided nature of the nose assembly 64 also permits the free flow of air therethrough for better cooling of the print head. Further, the inner and outer surfaces of members 98 and 100 also serve as a heat sink for the print head 2 to transfer heat not only to the air flowing through the nose assembly 64 but also to the area surrounding the nose assembly 64.

Figure 29:
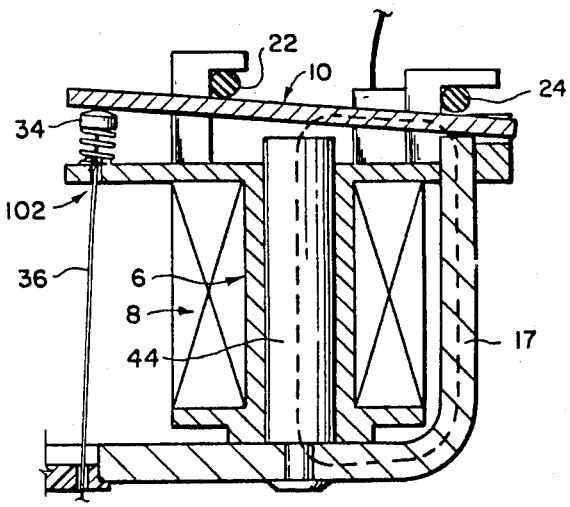
FIG. 29 is a cross-sectional view of a modified coil-wire guide assembly in which the wire guide for the impact end of the print wire is integral with the coil assembly.

FIG. 29 is a further modification in which the wire guide 102 adjacent the impact end 34 of print wire 36 is integral with the bobbin member 6 and supported in a fixed position relative thereto. In this manner, the coil-wire guide assembly of FIG. 29 which includes a bobbin member 6, coil member 8, clapper member 10, and wire guide 102 can be easily and quickly placed as a unit among the fixed pole pieces 44 and upstanding yoke portions 17 of the print head and can likewise be easily and quickly removed as a unit therefrom by selectively manipulating the retaining O-rings 22 and 24.

While several embodiments of the present invention have been described in detail herein, various changes and modifications can be made without departing from the scope of the invention.

We claim:

1. In a dot matrix printer mechanism having a print head extending along a first axis, an elongated head shaft extending along a second axis spaced a fixed distance from a platen, and a main guide bearing moveably mounted about said head shaft, said print head including means for mounting said print head to said main guide bearing with said first and second axes substantially perpendicular, the improvement including:

means for selectively moving said print head along said first axis relative to said second axis between at least first and second positions, said first and second axes being perpendicular to each other in said first and second positions, said moving means including said main guide bearing wherein said main guide bearing includes inner and outer substantially cylindrical surfaces, said inner and outer cylindrical surfaces being eccentric relative to each other with said inner cylindrical surface having an axis of symmetry colinear with said second axis and said outer cylindrical surface having an axis of symmetry parallel to and spaced from said second axis, said mounting means of said print head including means for rotatably receiving said outer cylindrical surface of said main guide bearing whereby as said main guide bearing is rotated about said second axis, said outer cylindrical surface thereof selectively moves said print head along said first axis relative to said second axis between said first and second positions to move said print head selectively toward and away from said platen, said outer cylindrical surface of said main guide bearing having a recess therein with a first planar surface extending parallel to said axis of symmetry of said inner cylindrical surface and said print head having a first portion receivable within said recess and including a second planar surface corresponding to said first planar surface, said mounting means mounting said print head to said main guide bearing in said first position with said first and second planar surfaces abutting, and said recess further including a third planar surface extending parallel to said axis of symmetry of said inner cylindrical surface and spaced about said axis of symmetry from said first planar surface, said mounting means selectively mounting said print head to said main guide bearing in said second position with said second and third surfaces abutting, said first and third planar surfaces being spaced an equal distance from said axis of symmetry of said inner cylindrical surface whereby said first and second axes are spaced the same distance from each other when said print head is in said first and second positions.

2. The dot matrix printer mechanism of claim 1 wherein said mounting means includes means for resiliently mounting said main guide member in an abutting relationship with said print head with a first force wherein said main guide member can be rotated relative to said print head about said second axis against said first force to selectively move said print head between said first and second position.

* * * * *